US009147925B2

(12) United States Patent
Dremelj et al.

(10) Patent No.: US 9,147,925 B2
(45) Date of Patent: Sep. 29, 2015

(54) ANTENNA COUPLER

(75) Inventors: Igor Dremelj, Unterägeri (CH); Heinz Hohl, Baar (CH)

(73) Assignee: Landis + Gyr AG, Zug (CH)

( * ) Notice: Subject to any disclaimer, the term of this patent is extended or adjusted under 35 U.S.C. 154(b) by 697 days.

(21) Appl. No.: 13/501,916

(22) PCT Filed: Aug. 6, 2010

(86) PCT No.: PCT/EP2010/004825
§ 371 (c)(1),
(2), (4) Date: Jun. 26, 2012

(87) PCT Pub. No.: WO2011/044965
PCT Pub. Date: Apr. 21, 2011

(65) Prior Publication Data

US 2012/0262254 A1 Oct. 18, 2012

(30) Foreign Application Priority Data

Oct. 14, 2009 (EP) ..... 09173079

(51) Int. Cl.
*H01P 5/02* (2006.01)
*H01P 5/18* (2006.01)
*H01P 3/08* (2006.01)

(52) U.S. Cl.
CPC ..... *H01P 5/187* (2013.01)

(58) Field of Classification Search
CPC ..... H03H 7/38; H01P 3/08; H01P 5/00
USPC ..... 333/33, 238, 260, 24 R
See application file for complete search history.

(56) References Cited

U.S. PATENT DOCUMENTS 4,987,391 A 1/1991 Kusiak, Jr.
5,689,216 A * 11/1997 Sturdivant ..... 333/33
6,023,209 A * 2/2000 Faulkner et al. ..... 333/238
6,903,459 B2 * 6/2005 Nakatani ..... 257/758

(Continued)

OTHER PUBLICATIONS

Bedair, Said S., Fast and Accurate Analytic Formulas for Calculating the Parameters of a General Broadside-Coupled Coplanar Waveguide for (M) MIC Applications, May 1989, pp. 843-850, vol. 37, No. 5, IEEE Transactions on Microwave Theory and Techniques, U.S.A.
Di Paolo, Franco, Chapter 10: Coplanar Waveguides in Networks and Devices Using Planar Transmission Lines, 2000, CRC Press LLC, Florida.

(Continued)

*Primary Examiner* — Dean Takaoka
(74) *Attorney, Agent, or Firm* — Maginot, Moore & Beck LLP

(57) ABSTRACT

In an antenna coupler, a multilayer printed-circuit board has conductor levels which are electrically isolated from one another in the depth direction. A first radio-frequency line coupled to the antenna is arranged in a first conductor level, while a second radio-frequency line coupled on the appliance side is arranged in a second conductor level of the board. The board has an electrically insulating core layer, with the first and second conductor levels extending on the same of the two faces of the core layer and with the second radio-frequency line at a greater distance from the core layer than the first radio-frequency line. Furthermore, the second radio-frequency line is arranged on an outer surface of the board. The antenna coupler comprises an electrically conductive shielding structure designed to shield the first radio-frequency line and appliance-side metal parts, which are not part of the antenna coupler, against interaction with radio-frequency signals.

12 Claims, 5 Drawing Sheets

(56) References Cited

U.S. PATENT DOCUMENTS

| | | | | |
|---|---|---|---|---|
| 7,498,897 | B2 * | 3/2009 | Yoshida et al. | 333/33 |
| 7,545,243 | B2 | 6/2009 | Serban | |
| 8,207,451 | B2 * | 6/2012 | Lu et al. | 174/262 |
| 2005/0017821 | A1 | 1/2005 | Sawicki | |
| 2009/0174499 | A1 * | 7/2009 | Hiramatsu et al. | 333/139 |

OTHER PUBLICATIONS

Chang, Chieh-Pin et al. A 3-dB Quadrature Coupler Using Broadside-Coupled Coplanar Waveguides, Mar. 2008, pp. 191-193, vol. 18, No. 3, IEEE Microwave and Wireless Components Letters, New York.

* cited by examiner

ANTENNA COUPLER

FIELD OF THE INVENTION

The present invention relates to the field of radio-frequency line technology; it relates in particular to an antenna coupler for connection of a radio-frequency antenna according to the preamble of claim 1.

BACKGROUND TO THE INVENTION

In many technical appliances which contain a radio-frequency transmitter or receiver and at the same time have a high-voltage with respect to ground (mains voltage) conductively applied to them, an antenna is intended to be connected via a coaxial cable. The corresponding antenna and the coaxial cable must be galvanically isolated from the appliance since there would otherwise be a lethal danger if they were touched.

Until now, the problem has been solved, for example by two dipole antennas arranged parallel in the appliance, although this results in a high continuity attenuation of at least 6 dB for the useful signal, because of the undesired radial emission. The output power was fed into a coaxial cable in order to be passed on to a remote antenna.

Known decoupling using capacitors (U.S. Pat. No. 4,987,391) has either a low dielectric strength (1 kV) or a high continuity attenuation, since capacitors have to be physically large for a high dielectric strength, and this has a negative effect on the attenuation, because of the high inductive reactance and the undesirable emission.

It is known from the document U.S. Pat. No. 7,545,243 that line structures are suitable for galvanic decoupling.

However, one disadvantage of this known solution is likewise the low dielectric strength.

DESCRIPTION OF THE INVENTION

The object of the invention is therefore to further develop an antenna coupler for connection of a radio-frequency antenna in such a way that the above-mentioned disadvantages can be overcome.

The problem on which the invention is based is solved by the totality of the features of claim 1. Further embodiments are subject matter of dependent claims 2 to 10.

The antenna coupler according to the invention for galvanicily isolation of the antenna from the transmitter/receiver achieves a high dielectric strength voltage of up to 12 kV DC and mains AC voltage, but at the same time also an extraordinary low continuity attenuation for the radio-frequency useful signal. The antenna coupler according to the invention can achieve a particularly low continuity attenuation within desired frequency limits since the coupling lines, that is to say the first and second radio-frequency lines, can be arranged at a particularly short distance from one another in the depth direction of the multilayer printed-circuit board. The normally used layer thickness of the multilayer printed-circuit board can be used as the separation between the coupling lines. By way of example, a separation of 0.3 mm can be achieved.

A wide usable radio-frequency bandwidth is achieved, which may be more than one octave, for example from 800 MHz to 2200 MHz. This can be produced cost-effectively using multilayer printed-circuit boards, for example double or quadruple multilayer printed-circuit boards.

The antenna coupler is therefore preferably in the form of a multilayer printed-circuit board. The coupler is formed from two radio-frequency lines which are coupled in a suitable manner. The geometric arrangement of the metal surfaces (in particular copper surfaces) of the radio-frequency lines forms the coupler. The separations between the copper surfaces and the electrically insulating substrate material of the multilayer printed-circuit board ensure the necessary isolation dielectric strength.

In the present case, the radio-frequency lines are two coplanar lines, which are embedded one above the other in two different layers of the multilayer printed-circuit board. These lines preferably each consist of at least one stripline for the inner conductor and at least two striplines for the outer conductor.

These two sets of three conductors are in one preferred embodiment chosen to be separated and to have line widths such that the resultant line has a characteristic impedance of 50 Ohm. This allows the radio-frequency power to be passed on from the coaxial cable to the transmitter/receiver in the interior of the appliance without any joints and therefore with low losses.

The thickness of the dielectric (dielectric material) is preferably chosen to achieve a dielectric strength as required in the respective application.

In preferred embodiments, the connections of the coplanar lines on the surface of the printed-circuit board comply with a leakage current distance as required for the desired dielectric strength. For this purpose, in one exemplary embodiment, the coplanar line (typically on the antenna side) which is located in the inner layer of the printed-circuit board is lengthened beyond the coupling zone with a different geometry, that is to say for example with a different conductor width and/or conductor separations, before contact is made with the surface.

The preferred embodiment of the antenna coupler according to the invention is in the form of a coupling structure which is shielded on one side. The appliance-side coplanar line has an additional shielding surface added to it, which is connected to printed-circuit board plated-through holes. The shielding surface is preferably arranged such that, together with the striplines of the appliance-side coplanar line, it partially encapsulates the coaxial line, that is to say the antenna-side coplanar line. This results at least in the shielding side being less sensitive to being influenced by metal parts in the interior of the appliance.

By way of example, the known material FR-4, a glass-fiber-reinforced, epoxy-based material, which has a dielectric strength of more than 30 kV/mm is suitable for use as an insulating substrate material in order to achieve a high dielectric strength for the multilayer printed-circuit board.

Sufficiently long leakage current distance must be ensured on the surface of the printed-circuit board between the galvanically isolated parts. By way of example, a leakage current distance of somewhat more than 10 mm is required for a dielectric strength of 12 kV.

The antenna coupler according to the invention will be described in the following text with reference to the figures. Only a detail of the antenna coupler, specifically the coupling area in the multilayer printed-circuit board, is in each case illustrated.

BRIEF DESCRIPTION OF THE FIGURES

The invention will be explained in more detail in the following text using exemplary embodiments and in conjunction with the drawing. The following color coding of the illustrated structural elements is used in the figures:

Light-blue: Air

Orange-red and yellow-green: Metal surfaces of striplines. Dark-blue and dark-green sections at the ends of striplines (center conductors) should be read in the same way as orange-red sections, that is to say they should be understood to be integral components of the respective stripline and, despite their different coloring, have the same meaning on these structural elements as an orange-red or yellow-green coloring.

Dark-green: Dielectric layer insulation

Light-green: Cover insulation or core layer (core) of the multilayer printed-circuit board.

Figure 1:
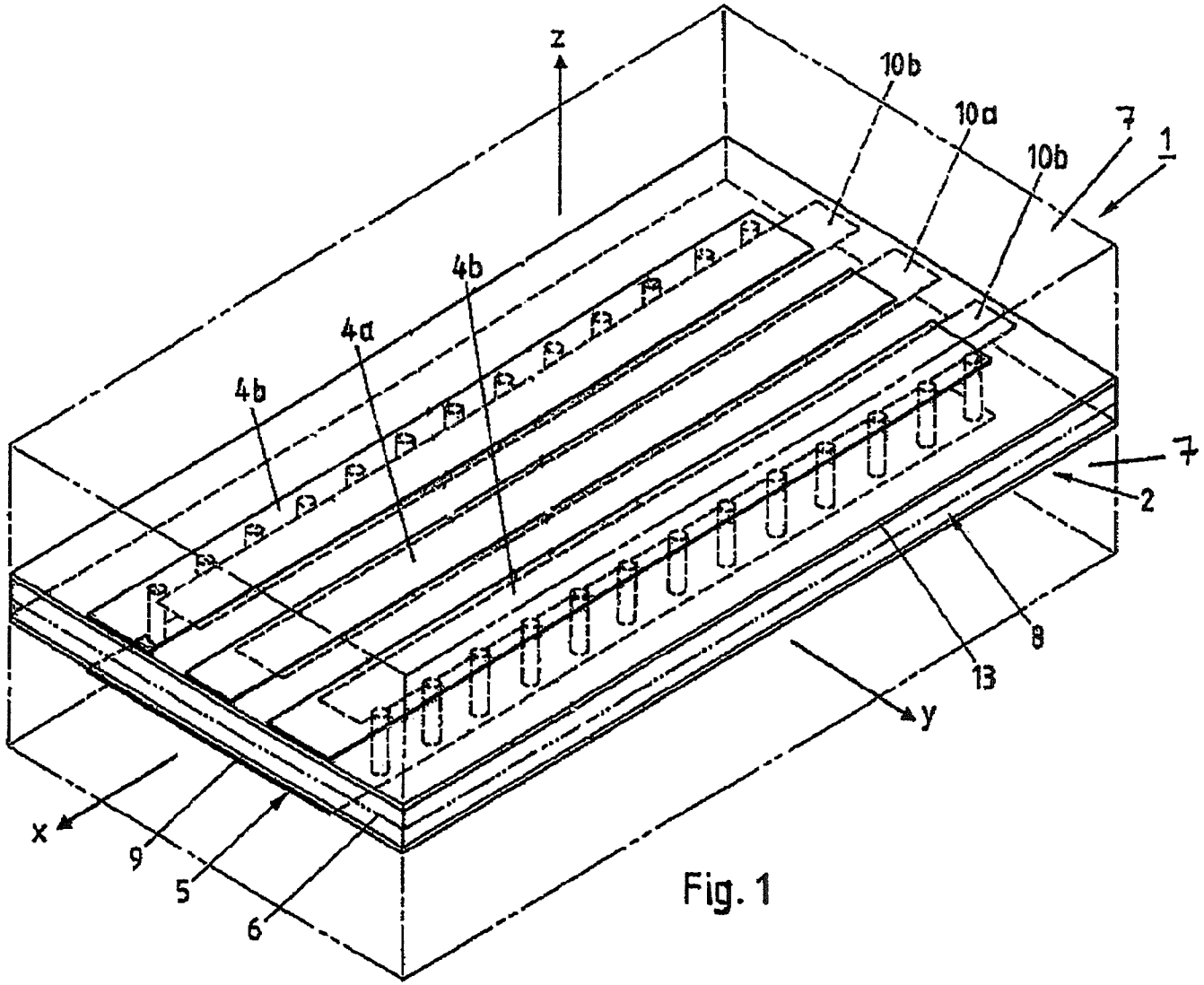
Figure 2:
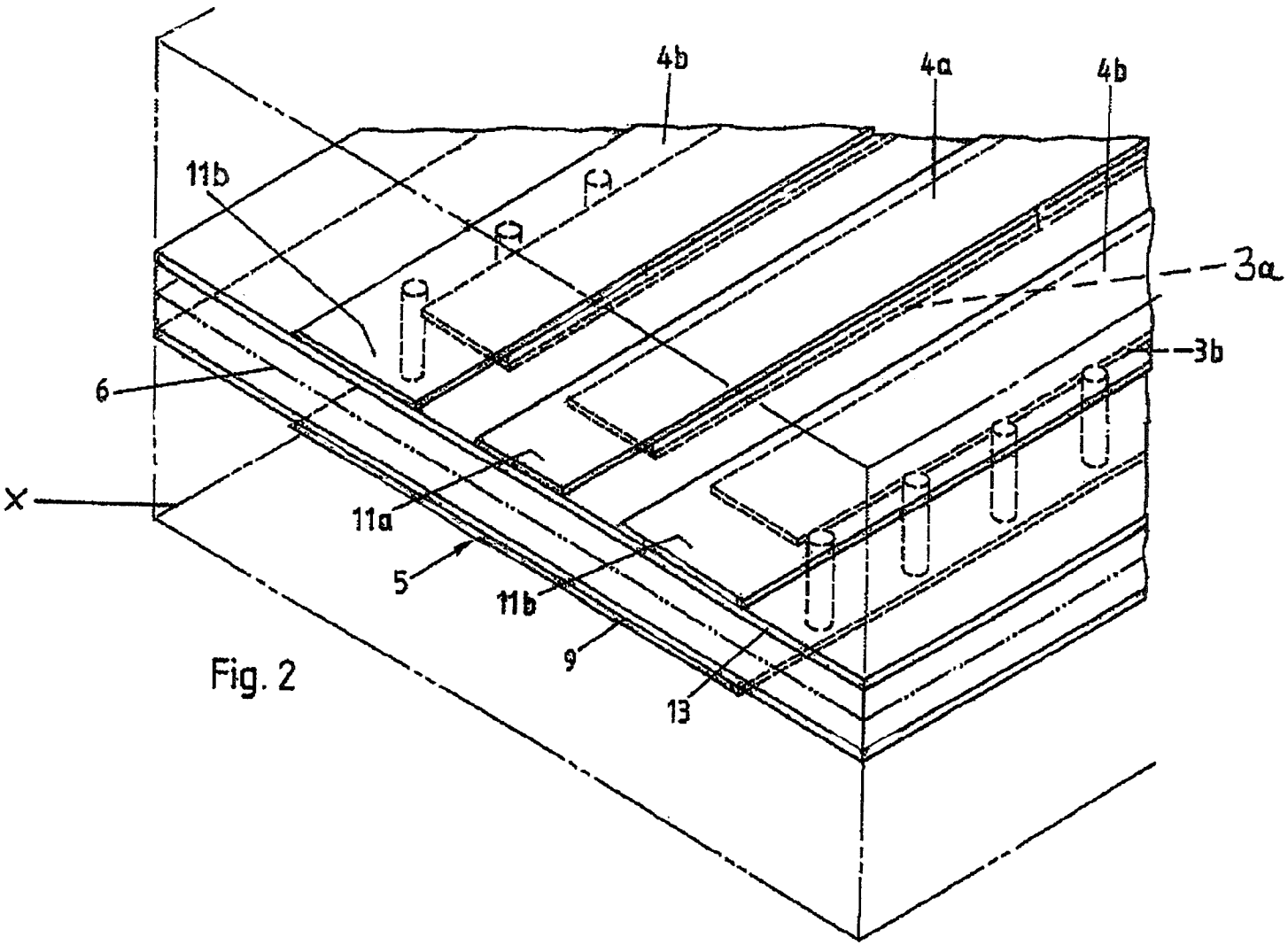
Figure 3:
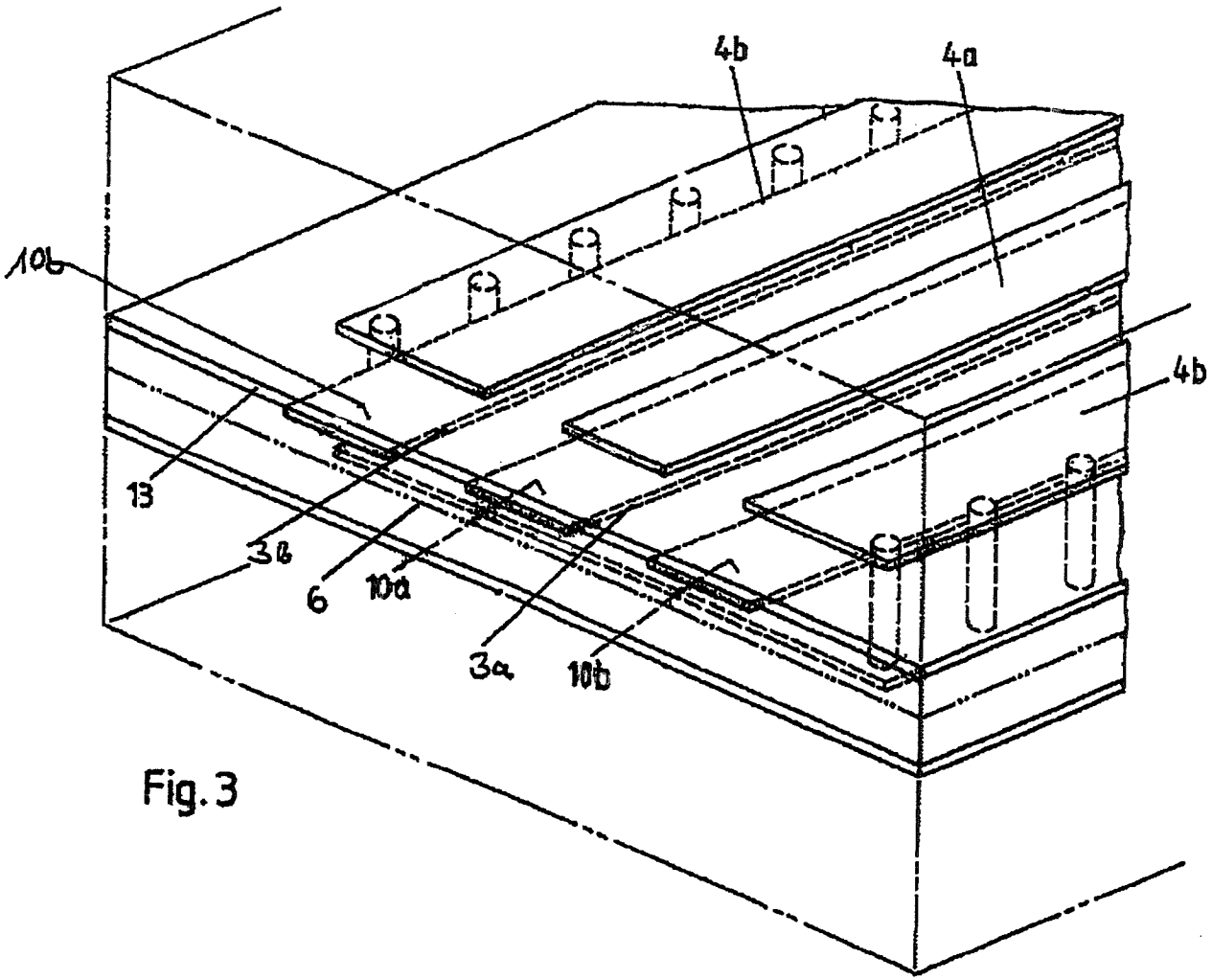
Figure 4:
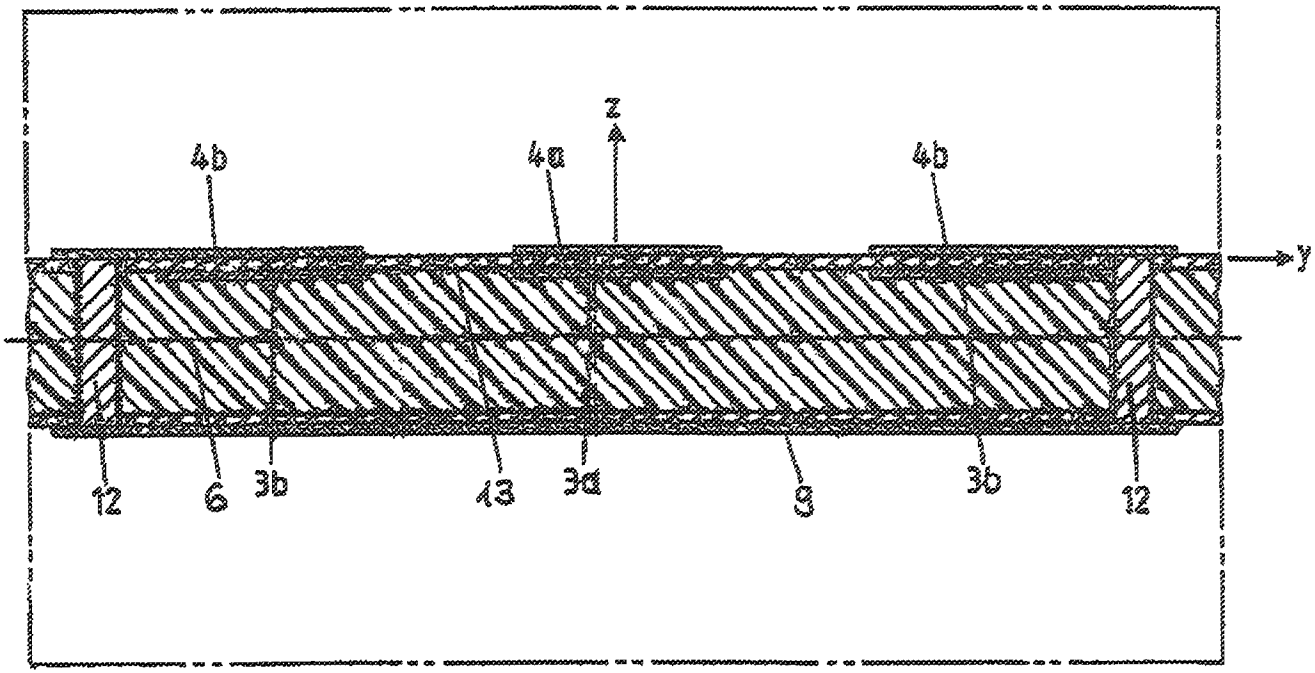
Figure 5:
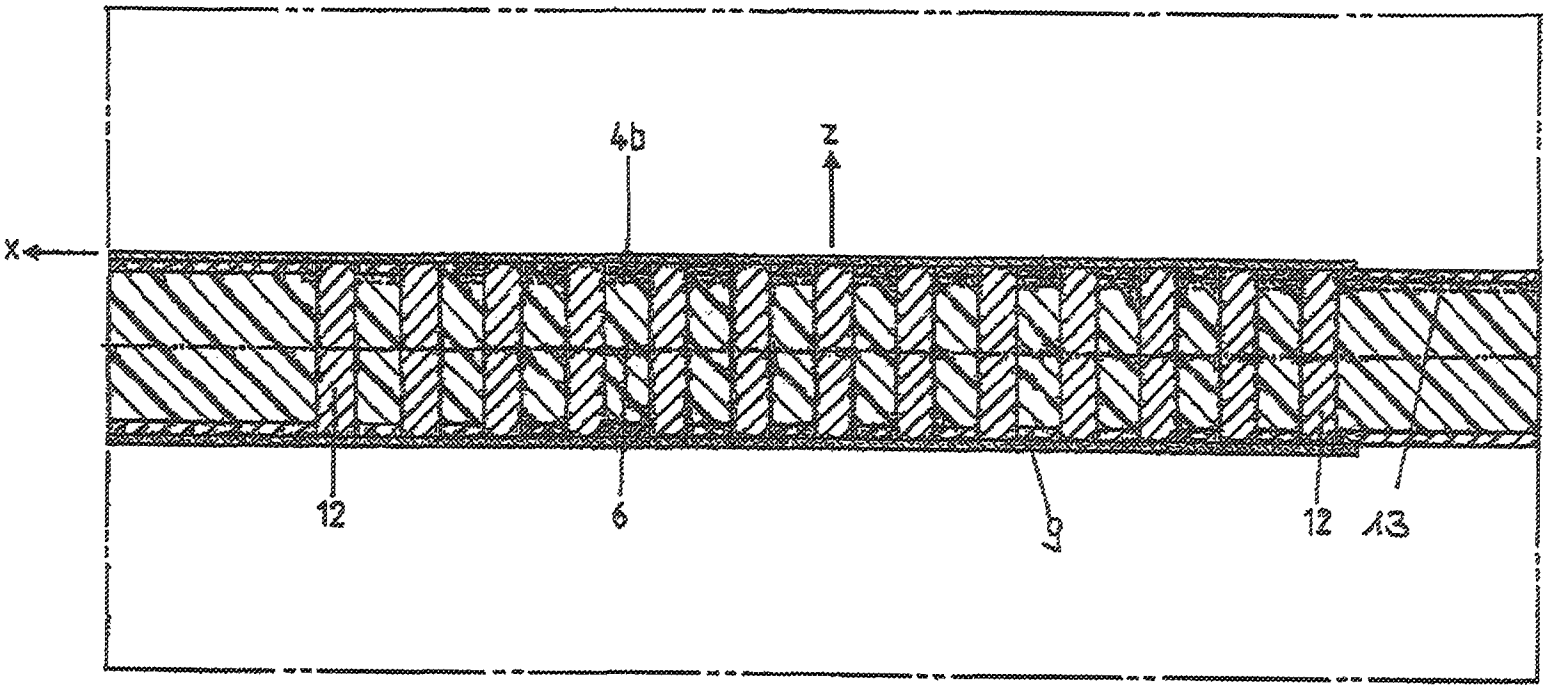

In the figures:

FIG. 1 shows a perspective view of an antenna coupler according to the invention having two isolated coplanar lines, which are separated from one another by layer insulation, on one face of a printed-circuit board core layer, and with an electrically conductive shielding structure, which extends partially on the opposite, other of the two faces of the printed-circuit board core layer and is designed to shield the first radio-frequency line and appliance-side metal parts, which are not part of the antenna coupler, against interaction with the carrying of radio-frequency signals;

FIG. 2 shows an enlarged perspective view of an appliance-side end section of the antenna coupler as shown in FIG. 1;

FIG. 3 shows an enlarged perspective view of the opposite antenna-side end section of the antenna coupler as shown in FIG. 1;

FIG. 4 shows a section view of the input-side section—yz plane illustrated—of the antenna coupler; and FIG. 5 shows a further section view—xz plane illustrated—of the antenna coupler.

DETAILED DESCRIPTION OF PREFERRED EMBODIMENTS

FIG. 1 shows a perspective view of an antenna coupler 1 according to the invention with two isolated coplanar lines 3*a*, 3*b*, 4*a*, 4*b* which are separated from one another by a layer insulation 13. Since the first coplanar line 3*a*, 3*b* is consistently concealed by the second coplanar line 4*a*, 4*b* in this illustration, FIG. 4 is intended to provide an assistance for the arrangement of the two coplanar lines 3*a*, 3*b*, 4*a*, 4*b* with respect to one another.

The coplanar lines 3*a*, 3*b*, 4*a*, 4*b* are arranged on one face of a printed-circuit board core layer 6 and are shielded by an electrically conductive shielding structure 5, with this shielding structure 5 extending partially on the opposite, other of the two faces of the printed-circuit board core layer 6 and being designed such that the first radio-frequency line 3*a*, 3*b* and appliance side metal parts, which are not illustrated here and are not part of the antenna coupler, do not interact with the carrying of radio-frequency signals.

In FIG. 1, both coplanar lines 3*a*, 3*b*, 4*a*, 4*b* are in each case arranged in the sequence outer conductor 3*b*, 4*b*-inner conductor 3*a*, 4*a*-outer conductor 3*b*, 4*b* in the y-direction of the illustrated coordinate system. In the z-direction of the coordinate system, a metal surface or shielding surface 9—an intermediate layer composed of dielectric material 8—an antenna-side (first) coplanar line 3*a*, 3*b*-layer insulation 13—appliance-side (second) coplanar line 4*a*, 4*b* follow one another.

The coplanar lines 3*a*, 3*b*, 4*a*, 4*b* run parallel to one another in the longitudinal direction x in the multilayer printed-circuit board (2); apart from short antenna-side and appliance-side length sections (striplines 10*a*, 10*b*, 11*a*, 11*b*), the coplanar lines 3*a*, 3*b*, 4*a*, 4*b* completely cover one another in the longitudinal direction, and they completely cover one another in their lateral direction y at right angles to the longitudinal direction x.

The following values are helpful as exemplary dimensions for the embodiment of the antenna coupler according to the invention as described here, in which case the values indicated here for the width are to be observed in the y direction, the length values in the x direction and the thickness values in the z direction:

Inner conductor width 3*a*, 4*a*; 3 mm

Outer conductor width 3*b*, 4*b*; 2 mm

Coplanar line lengths 3*a*, 3*b*, 4*a*, 4*b*: 25 mm

Layer insulation thickness 13: 0.3 mm

Relative dielectric constant of the $\in_r$=4.5 layer insulation 13:

Lateral separation between the inner 1.2 mm conductors 3*a*, 4*a* and the outer conductors 3*b*, 4*b*:

FIG. 1 likewise shows striplines 10*a*, 10*b* which project in the longitudinal direction x of the first coplanar line, or of the first radio-frequency line 3*a*, 3*b*, beyond the second coplanar line, or second radio-frequency line 4*a*, 4*b*, for connection to a coaxial line, which is not illustrated here, to an antenna; this situation will become even clearer in the following combination with FIG. 3.

In FIG. 1, 7 denotes air as the medium surrounding the antenna coupler 1; the air has no further function other than insulating characteristics.

FIG. 2 shows an enlarged perspective view of an appliance-side end section of the antenna coupler as shown in FIG. 1. This clearly shows that the second radio-frequency line 4*a*, 4*b* has striplines 11*a*, 11*b* which project in the x direction beyond the first radio-frequency line 3*a*, 3*b*, for connection to an appliance which is not shown in any more detail here.

As already indicated with reference to FIG. 1, FIG. 3 shows an enlarged perspective illustration of the antenna-side end section on the antenna coupler with the striplines 10*a*, 10*b* for the first radio-frequency line 3*a*, 3*b*.

FIG. 4 shows a section view relating to the yz plane, illustrating how the second radio-frequency line 4*a*, 4*b* with its outer conductor 4*b*, but not with its inner conductor 4*a*, is connected electrically conductively through the printed-circuit board core layer 6 to the metal surface 9 on the opposite, other of the two faces of the printed-circuit board core layer 6, for shielding purposes. FIG. 5 shows a further section illustration of the xz plane of the antenna coupler. This clearly shows that a multiplicity of connections and printed-circuit board plated-through holes 12 keep the outer conductor 4*b* and metal surface 9 at the same potential.

The invention proposed here is, of course, not restricted to the illustrated embodiments; without departing from the idea of the invention, it is, of course, also possible, for example, to couple the second radio-frequency line 4*a*, 4*b* on the antenna side, while the first radio-frequency line 3*a*, 3*b* can be coupled on the appliance side.

LIST OF REFERENCE SYMBOLS

1 Antenna coupler

2 Multilayer printed-circuit board

3*a*, 3*b* First radio-frequency line with inner conductor and outer conductor, first coplanar line

4*a*, 4*b* Second radio-frequency line with inner conductor and outer conductor, second coplanar line

5 Shielding structure

6 Printed-circuit board core layer

7 Air

8 Dielectric material

9 Metal surface, shielding surface
10*a*, 10*b* Stripline for 3*a*, 3*b*
11*a*, 11*b* Stripline for 4*a*, 4*b*
12 Connection, printed-circuit board plated-through holes
13 Layer insulation

The invention claimed is:

1. An antenna coupler for connection of a radio-frequency antenna to an appliance to which a high voltage can be conductively applied during operation, comprising a multilayer printed-circuit board having conductor levels which are electrically isolated from one another in the depth direction of the multilayer printed-circuit board, at least one first radio-frequency line, which can be coupled or is coupled to the radio-frequency antenna, in a first conductor level of the conductor levels, at least one second radio-frequency line, which can be coupled or is coupled on the appliance side, in a second conductor level of the conductor levels, wherein the multilayer printed-circuit board has an electrically insulating printed-circuit board core layer, the first and second conductor levels extend on the same of the two faces of the printed-circuit board core layer, the second radio-frequency line, which can be coupled or is coupled on the appliance side, is arranged at a greater distance from the printed-circuit board core layer than the first radio-frequency line, the second radio-frequency line is arranged on an outer surface of the multilayer printed-circuit board, and the antenna coupler has an electrically conductive shielding structure, part of which extends on the opposite, other of the two faces of the printed-circuit board core layer and is designed to shield the first radio-frequency line and appliance-side metal parts, which are not part of the antenna coupler, against interaction with the carrying of radio-frequency signals.

2. The antenna coupler as claimed in claim 1, wherein the first and second radio-frequency lines in the multilayer printed-circuit board run parallel to one another in the longitudinal direction of the first and second radio-frequency lines.

3. The antenna coupler as claimed in claim 1, wherein the radio-frequency lines completely cover one another in the longitudinal direction—apart from short antenna-side and appliance-side length sections of the radio-frequency lines.

4. The antenna coupler as claimed in claim 1, wherein the separated radio-frequency lines completely cover one another in their lateral direction at right angles to the longitudinal direction.

5. The antenna coupler as claimed in claim 1, wherein the radio-frequency lines are in the form of coplanar lines.

6. The antenna coupler as claimed in claim 1, wherein the antenna coupler has a dielectric strength of up to 12 kV between the first and second conductor levels.

7. The antenna coupler as claimed in claim 1, wherein each conductor level has at least one stripline for coupling to an antenna-side and appliance-side inner conductor, respectively, and at least two striplines for coupling to a respective antenna-side and appliance-side outer conductor.

8. The antenna coupler as claimed in claim 7, wherein the striplines of the first and second radio-frequency lines have a respective lateral distance, that is to say a distance which can be measured at right angles to the longitudinal direction of the striplines, from one another in the relevant conductor level, and have a respective width, which can be measured in the lateral direction in the relevant conductor level, which in combination result in the relevant radio-frequency line having a characteristic impedance of 50 Ohm.

9. The antenna coupler as claimed in claim 7, in which the second radio-frequency line is electrically conductively connected by its outer conductor, but not by its inner conductor, through the printed-circuit board core layer to the metal surface on the opposite, other of the two faces of the printed-circuit board core layer.

10. The antenna coupler as claimed in claim 1, wherein the shielding structure has a metal surface which partially sheaths the first radio-frequency line.

11. The antenna coupler as claimed in claim 10, in which the second radio-frequency line is electrically conductively connected by its outer conductor, but not by its inner conductor, through the printed-circuit board core layer to the metal surface on the opposite, other of the two faces of the printed-circuit board core layer.

12. An antenna coupler for connection of a radio-frequency antenna to an appliance to which a high voltage can be or is conductively applied during operation, comprising a printed-circuit board with at least one first coplanar radio-frequency line, which can be coupled or is coupled to the radio-frequency antenna, and with at least one second coplanar radio-frequency line, which can be coupled or is coupled on the appliance side and is galvanically isolated from the first coplanar radio-frequency line, wherein the printed-circuit board has an electrically insulating printed-circuit board core layer with two faces, the first and second coplanar radio-frequency lines extend on the same of the two faces of the printed-circuit board core layer, the second coplanar radio-frequency line is arranged at a greater distance from the printed-circuit board core layer than the first coplanar radio-frequency line, and the antenna coupler has an electrically conductive shielding structure, part of which extends on the opposite, other of the two faces of the printed-circuit board core layer and is designed to shield the first coplanar radio-frequency line against interaction with the carrying of radio-frequency signals.

* * * * *